US010273723B2

(12) United States Patent
Kim et al.

(10) Patent No.: US 10,273,723 B2
(45) Date of Patent: Apr. 30, 2019

(54) OPPOSED OPENING AND CLOSING TYPE DOOR STRUCTURE OF VEHICLE

(71) Applicant: Hyundai Motor Company, Seoul (KR)

(72) Inventors: Duck Young Kim, Gyeonggi-do (KR); Jung Hoon Park, Gyeonggi-Do (KR)

(73) Assignee: Hyundai Motor Company, Seoul (KR)

( * ) Notice: Subject to any disclaimer, the term of this patent is extended or adjusted under 35 U.S.C. 154(b) by 346 days.

(21) Appl. No.: 15/232,052

(22) Filed: Aug. 9, 2016

(65) Prior Publication Data

US 2017/0306659 A1 Oct. 26, 2017

(30) Foreign Application Priority Data

Apr. 20, 2016 (KR) ..... 10-2016-0048307

(51) Int. Cl.

| | |
|---|---|
| ***E05C 7/04*** | (2006.01) |
| ***E05B 77/46*** | (2014.01) |
| ***E05B 79/20*** | (2014.01) |
| ***E05B 85/04*** | (2014.01) |
| ***E05B 83/36*** | (2014.01) |
| ***E05C 9/04*** | (2006.01) |
| ***E05C 9/22*** | (2006.01) |
| ***E05C 9/20*** | (2006.01) |

(52) U.S. Cl.

CPC ..... *E05B 77/46* (2013.01); *E05B 79/20* (2013.01); *E05B 83/36* (2013.01); *E05B 85/04* (2013.01); *E05C 9/042* (2013.01); *E05C 9/20* (2013.01); *E05C 9/22* (2013.01)

(58) Field of Classification Search

CPC ..... E05B 77/46; E05B 85/04; E05B 83/36; E05C 9/20; E05C 9/042; E05C 9/22; E05D 2015/586; E05D 5/0207; E05D 3/00; B60J 5/0477; B60J 5/0479; B60J 5/047; B60J 5/0472; E05Y 2900/531

USPC ..... 49/366, 370, 404, 453

See application file for complete search history.

(56) References Cited

U.S. PATENT DOCUMENTS

| | | | | |
|---|---|---|---|---|
| 5,896,704 | A * | 4/1999 | Neag | E05D 15/1081 296/155 |
| 6,059,352 | A * | 5/2000 | Heldt | B60J 5/0479 292/11 |
| 6,196,618 | B1 * | 3/2001 | Pietryga | B60J 5/0479 16/82 |
| 6,386,621 | B1 * | 5/2002 | Kozak | B60J 5/047 16/278 |

(Continued)

FOREIGN PATENT DOCUMENTS

| | | | |
|---|---|---|---|
| JP | 4622093 | B2 | 2/2011 |
| JP | 2012-017024 | A | 1/2012 |
| KR | 20-0327132 | Y1 | 9/2003 |

*Primary Examiner* — Chi Q Nguyen

(74) *Attorney, Agent, or Firm* — Mintz Levin Cohn Ferris Glovsky and Popeo, P.C.; Peter F. Corless

(57) ABSTRACT

An opposed opening and closing type door structure of a vehicle is provided. The opposed opening and closing type door structure includes a front door and a rear door that are rotatably disposed in the vehicle to be oppositely opened and closed. A center pillar is rotatably disposed in the rear door and an active striker is disposed in the front door. A latch locked with or released from the active striker and is disposed in the center pillar. Accordingly, the weight of the vehicle and the number of parts of the vehicle is reduced and the front door and the rear door are independently opened and closed.

10 Claims, 16 Drawing Sheets

(56) References Cited

U.S. PATENT DOCUMENTS

| | | | | |
|---|---|---|---|---|
| 2003/0006629 | A1* | 1/2003 | Kimura | B60J 5/0477 296/203.03 |
| 2005/0264031 | A1* | 12/2005 | Mitsui | E05B 85/24 296/146.9 |
| 2007/0152473 | A1* | 7/2007 | Lechkun | B60J 5/0479 296/146.12 |
| 2009/0051194 | A1* | 2/2009 | Elliott | B60J 5/0479 296/146.11 |
| 2009/0072583 | A1* | 3/2009 | Elliott | B60J 5/0479 296/155 |
| 2010/0171336 | A1* | 7/2010 | Elliott | B60J 5/06 296/146.12 |
| 2012/0049580 | A1* | 3/2012 | Konchan | B60J 5/0479 296/202 |
| 2013/0278017 | A1* | 10/2013 | Arikai | B62D 25/04 296/193.06 |
| 2017/0254132 | A1* | 9/2017 | Stoof | B60J 10/86 |

* cited by examiner

OPPOSED OPENING AND CLOSING TYPE DOOR STRUCTURE OF VEHICLE

CROSS-REFERENCE TO RELATED APPLICATION

This application claims priority to and the benefit of Korean Patent Application No. 10-2016-0048307 filed in the Korean Intellectual Property Office on Apr. 20, 2016, the entire contents of which are incorporated herein by reference.

BACKGROUND

(a) Field of the Invention

The present invention relates to a door structure of a vehicle, and more particularly, to an opposed opening and closing type door structure of the vehicle.

(b) Description of the Related Art

Generally, a vehicle has a predetermined passenger compartment formed therein for boarding of a driver and accompanying occupants. Further, passenger compartment doors are coupled to the vehicle body to allow the passenger access to the passenger compartment. In a passenger vehicle, the passenger compartment doors are front doors coupled to a front portion of the vehicle in the length direction of the vehicle. The rear doors are coupled to a rear portion of the vehicle in the length direction of the vehicle. Typically, the front doors and the rear doors are rotatably coupled to the vehicle body via hinges and are configured to be opened and closed in the same direction.

Recently, for convenient entering and exiting the passenger compartment of the vehicle, an opposed opening and closing type door has been developed. In particular, a center pillar or a B pillar is rotatably disposed in a rear door and a front door. The doors are respectively disposed with latches to open the front door first when opening the doors and the rear door is configured to close c first when closing the doors. Since the front door is configured to be opened first and the rear door are closed first in such a conventional opposed opening and closing type door structure, the sequential opening and closing order is required to properly open and close the doors of the vehicle. Further, since latches are disposed in each of the front door and the rear door, the weight and manufacturing cost of the vehicle increases.

The above information disclosed in this section is merely for enhancement of understanding of the background of the invention and therefore it may contain information that does not form the prior art that is already known in this country to a person of ordinary skill in the art.

SUMMARY

The present invention provides an opposed closing and opening type door structure having a front door and a rear door to configured to be opened and closed using a single latch and an active striker. Accordingly, either the front or rear doors may be used to open or close the doors which increases the degree of freedom in sequence of opening and closing of the front door and the rear door.

An opposed opening and closing type door structure of a vehicle according to an exemplary embodiment may include a front door and a rear door rotatably disposed in the vehicle and configured to be oppositely opened and closed, a center pillar rotatably disposed in the rear door, an active striker disposed in the front door and a latch configured to be engaged or disengaged from the active striker and disposed within the center pillar.

The center pillar may be rotatably disposed in the rear door via a hinge. An upper rail and a lower rail disposed in the door structure may be respectively provided with first and second locking grooves separated from each other. The locking pins may be disposed in an upper portion and a lower portion of the center pillar. An upper portion and a lower portion of the front door may be inserted and coupled to the first and second locking grooves or may be released from the first and second locking grooves.

The active striker may include a striker body formed in a shape of a block and having one mounting aperture, a locking rod formed in the shape of a right angle (e.g., having a "ㄱ" shape) and coupled to the striker, and a movable rod that forms a locking aperture by being coupled to the locking rod or separated from the locking rod to open the locking rod, and provided with an inclined portion. The active striker may further include a restoration spring coupled to an exterior surface of the movable rod and configured to elastically support the movable rod. A first end of an operation cable may be coupled to an end of the movable rod and a second end of the operation cable may be coupled to an exterior handle disposed in the front door.

In some exemplary embodiments, the latch may include a crew rotatably disposed in a rotation shaft and provided with a locking groove configured to engage or disengage the active striker and a return spring may be configured to return the crew to an original location or a position by elastically supporting the crew. The crew may be coupled to a first end of an operation rod and a second end of the operation cable may be connected to an exterior handle disposed in the rear door. The hinge may include a first mounting flange coupled to the center pillar a second mounting flange coupled to the rear door a hinge shaft having the first and second mounting flanges are rotatably disposed thereon and a torsion spring wound around the hinge shaft.

The first locking groove of the upper rail may have a linear arrangement and the second locking groove of the upper rail may be formed in the shape of a circular arc. A first catching protrusion may protrude in to the first locking groove of the upper rail and a second catching protrusion may protrude in to the second locking groove. The first locking groove of the lower rail may have a linear arrangement and the second locking groove of the lower rail may be formed in the shape of a circular arc. A first catching protrusion and a second catching protrusions may be disposed, respectively, in the first and second locking grooves of the lower rail. A locking end may be releasably coupled by the first and second catching protrusions may be disposed in the locking pin.

The locking pin may include a pin body formed in the shape of a quadrangular block and a return spring may be configured to elastically support the pin body from a lower portion of the pin body. The pin body may include a cut-out groove that may be partially removed and disposed in an upper surface of the pin body and an inclined portion connected with the cut-out groove.

According to the exemplary embodiment, the front door and the rear door may be configured to be independently opened or closed using the latch disposed in the front door and the active striker disposed in the rear door in the opposed opening and closing type door structure of the vehicle. Accordingly, that degree of freedom in closing and opening of the doors may be improved and the doors may be conveniently opened and closed in an alternating sequence. Additionally, since the center pillar may be rotatably disposed in the rear door, degree of design freedom of the front door and the rear door may be improved. The thickness of the door may also be reduced and habitability of the passenger compartment may be improved. Further, since one latch is used, the weight of the vehicle and manufacturing cost may be reduced.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION

Hereinafter, an exemplary embodiment of the present invention will be described in detail with reference to the accompanying drawings.

The present disclosure will be described more fully hereinafter with reference to the accompanying drawings, in which exemplary embodiments of the invention are shown. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. For example, in order to make the description of the present invention clear, unrelated parts are not shown and, the thicknesses of layers and regions are exaggerated for clarity. Further, when it is stated that a layer is "on" another layer or substrate, the layer may be directly on another layer or substrate or a third layer may be disposed therebetween. It is understood that the term "vehicle" or "vehicular" or other similar term as used herein is inclusive of motor vehicle in general such as passenger automobiles including sports utility vehicles (SUV), buses, trucks, various commercial vehicles, watercraft including a variety of boats, ships, aircraft, and the like and includes hybrid vehicles, electric vehicles, combustion, plug-in hybrid electric vehicles, hydrogen-powered vehicles and other alternative fuel vehicles (e.g. fuels derived from resources other than petroleum).

Figure 1:
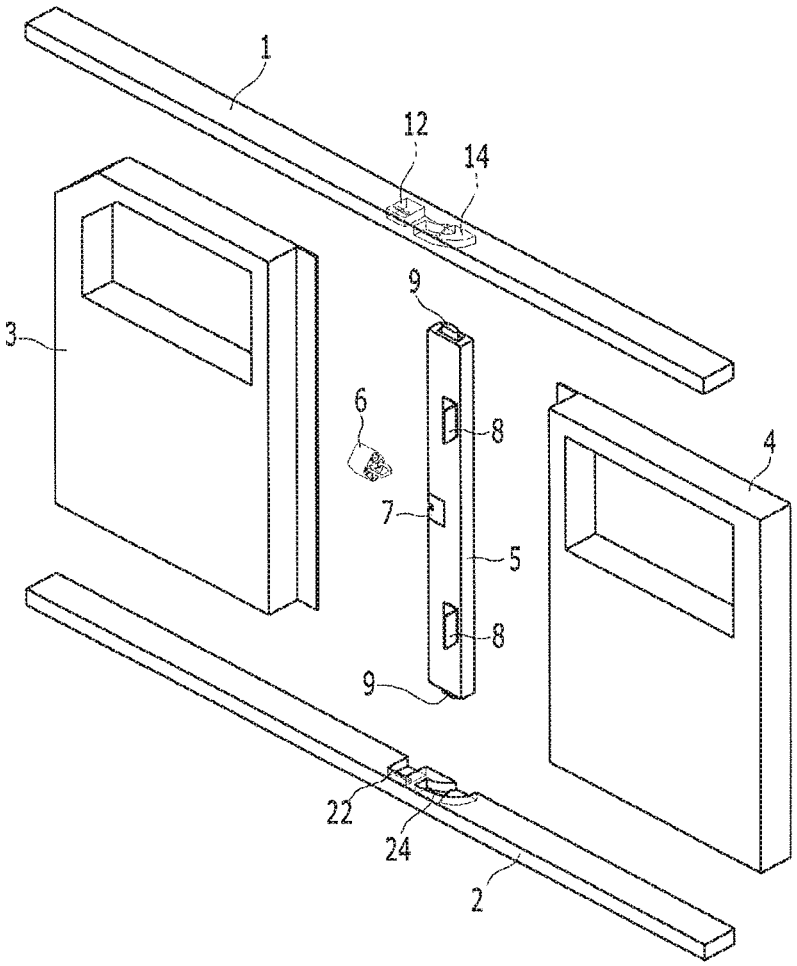
FIG. 1 is an exemplary exploded perspective view of an opposed opening and closing type door according to an exemplary embodiment of the present invention.
Figure 2:
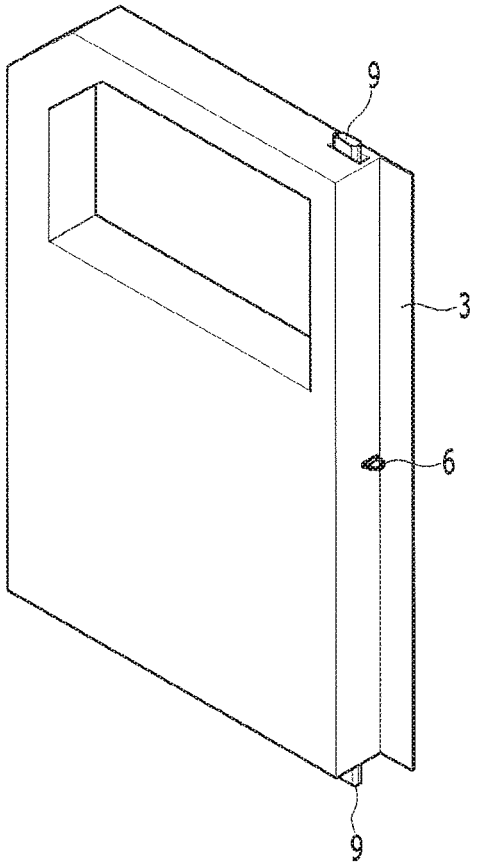
FIG. 2 is an exemplary perspective view of a front door according to the exemplary embodiment of the present invention.
Figure 3:
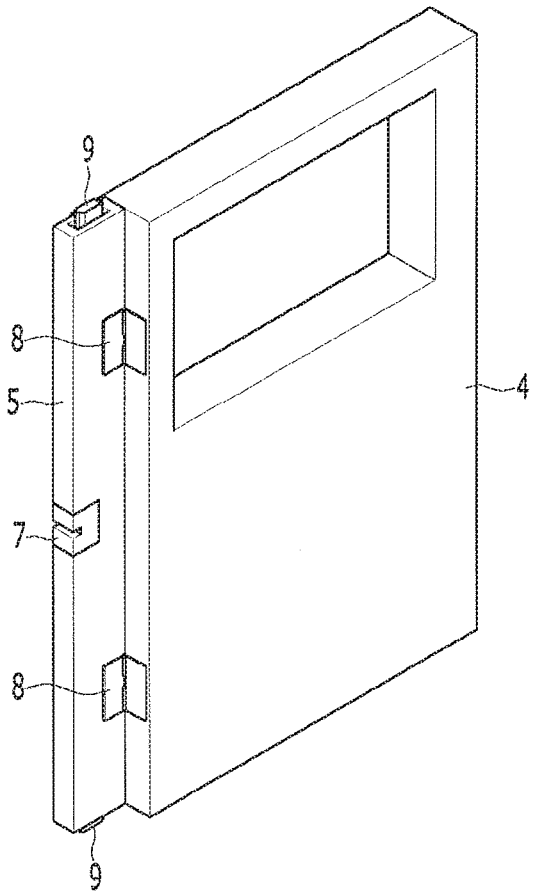
FIG. 3 is an exemplary perspective view of a rear door according to the exemplary embodiment of the present invention.

Referring to FIG. 1 to FIG. 3, an opposed opening and closing type door structure of a vehicle according to an exemplary embodiment of the present invention may include an upper rail 1 and a lower rail 2. The upper rail 1 may be coupled to an upper portion of a door opening formed in a vehicle body and the lower rail 2 may be coupled to a lower portion of the door opening.

Two locking grooves, a first locking groove 12 and a second locking groove 14, may be formed at a predetermined distance from each other in the upper rail 1. Two locking grooves 22 and 24 may be formed to be separated from each other in the lower rail 2. In particular, to open and close the door opening a front door 3 and a rear door 4 may be rotatably installed via a hinge in the vehicle body. A center pillar 5 may be rotatably disposed in the rear door 4 via at least one hinge 8. An active striker 6 may be disposed in the front door 3 and a latch 7 may be configured to be engaged or disengaged from the active striker 6 and may be disposed in the center pillar 5. Locking pins 9 may be disposed in the upper and lower portions of the center pillar 5 and the upper and lower portions of the front door 3. The locking pins 9 may be configured to be inserted into the locking grooves 12, 14, 22, and 24 and may be temporarily fixed or released from the locking grooves 12, 14, 22, and 24.

Figure 4:
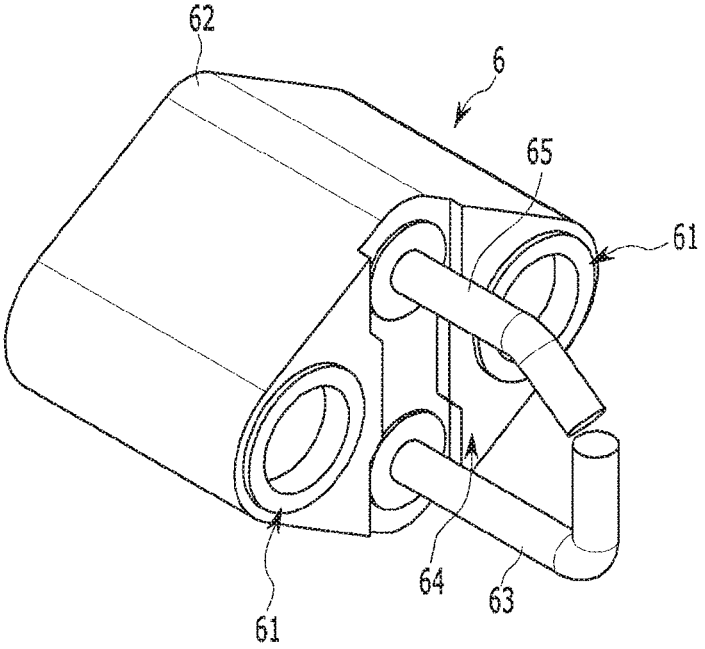
FIG. 4 is an exemplary perspective view of an active striker according to the exemplary embodiment of the present invention.
Figure 5:
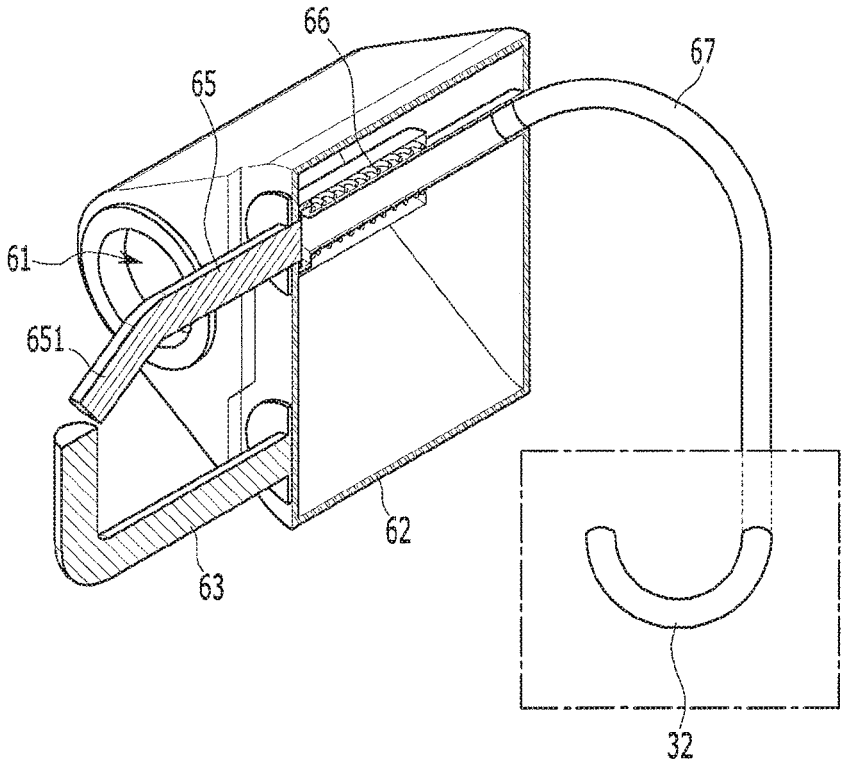
FIG. 5 is an exemplary cross-sectional view of the active striker according to the exemplary embodiment of the present invention.
Figure 6:
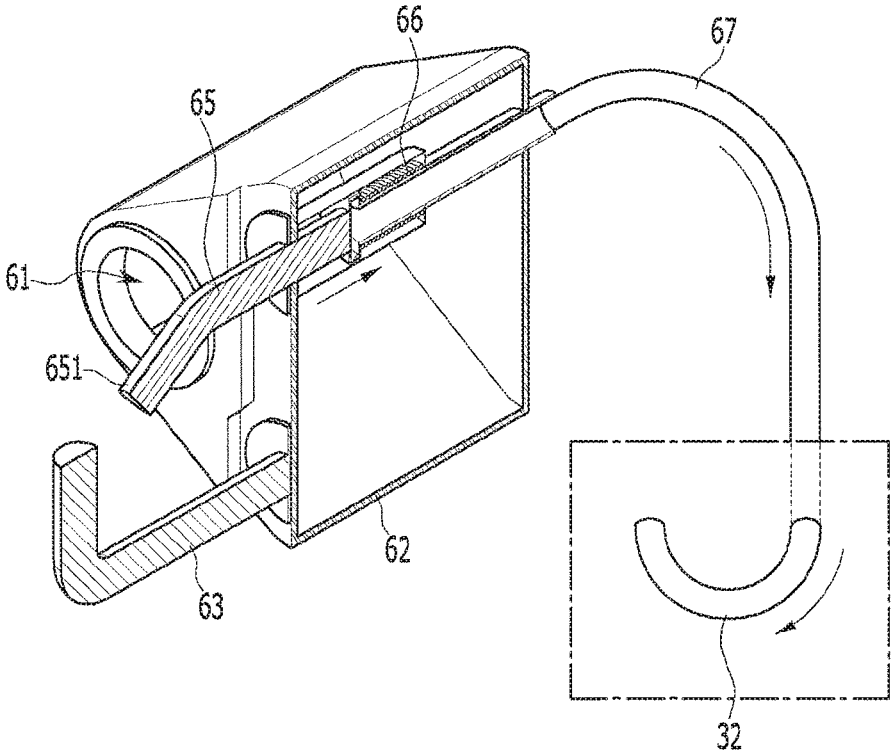
FIG. 6 is an exemplary cross-sectional view illustrating operation of the active striker according to the exemplary embodiment of the present invention.

Referring to FIG. 4 to FIG. 6, the active striker 6 disposed in the front door 3 may include a striker body 62 formed in the shape of a block and disposed with at least one mounting aperture 61, a locking rod 63 may be formed in a right angle shape (e.g., in the shape of a "ㄱ") and may be disposed in the striker body 62 in a fixed manner. Further, the active striker 6 may include a movable rod 65 disposed with an inclined portion 651 and may be configured to form a locking groove 64 when coupled with the locking rod 63 or may be configured to open the locking groove 64 by being separated from the locking rod 63 and a restoration spring 66 may be coupled to an exterior circumference of the movable rod 65 and configured to elastically support the movable rod 65.

A first end of an operation cable 67 may be coupled to an end of the movable rod 65 and a second end of the operation cable 67 may be coupled to an exterior handle 32 disposed in the front door 3. When the exterior handle 32 is pulled to open the front door 3, the movable rod 65 may be pulled as marked by the arrow in FIGS. 4 to 6 while the operation cable 67 receives a tension to open the locking aperture 64. The active striker 6 may be released from the latch 7 through the opened locking aperture 64 to open the front door 3. In other words, the front door 3 may be independently opened without regard to the position of the rear door 4.

Figure 7:
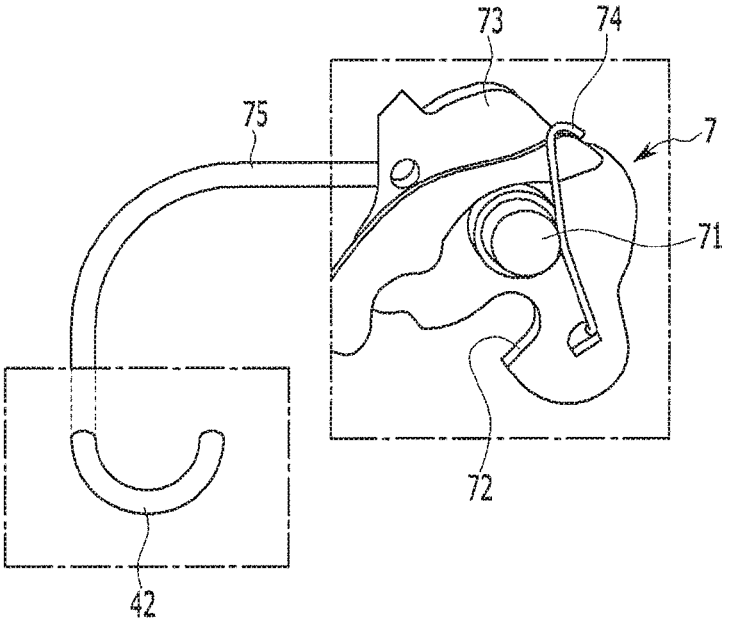
FIG. 7 is an exemplary cross-sectional view of a latch according to the exemplary embodiment of the present invention.

Referring to FIG. 7, the latch 7 disposed in center pillar 5 may be a known latch and may include a crew 73 rotatably disposed in a rotation shaft 71 and may include a locking aperture 72 configured to engage or disengage (e.g., lock or release) the active striker 6 and a return spring 74 that returns the crew 73 to an origin location by elastically supporting the crew 73. A first end of the operation cable 75 may be connected to the crew 73 and a second end of the operation cable 75 may be connected to the exterior handle 42 disposed in the rear door 4. Accordingly, when the exterior hand 42 of the rear door 4 is pulled, the crew 73 may be released from the active striker 6 through rotation to independently open the rear door 4 without regard to the position of the front door 3 (e.g., whether the front door is opened). Further, when the rear door 4 is closed, the rear door 4 may be locked with the front door by fitting the active striker 6 to the locking aperture 72.

Figure 8:
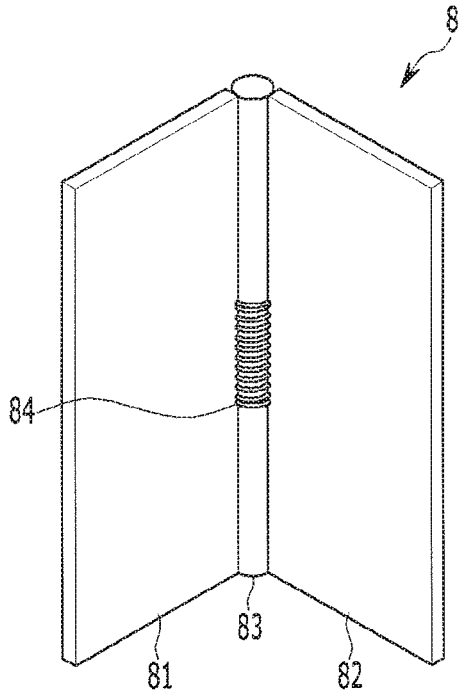
FIG. 8 is an exemplary perspective view of a hinge according to the exemplary embodiment of the present invention.

Referring to FIG. 8, in the hinge 8, a first mounting flange 81 coupled to the center pillar 5 and a second mounting flange 82 coupled to the rear door 4 may be configured to be rotatably coupled to a hinge shaft 83. A torsion spring 84 may be wound around the hinge shaft 83 to receive the elastic force the first mounting flange 81 and the second mounting flange 82 in opposite directions, respectively.

Figure 9:
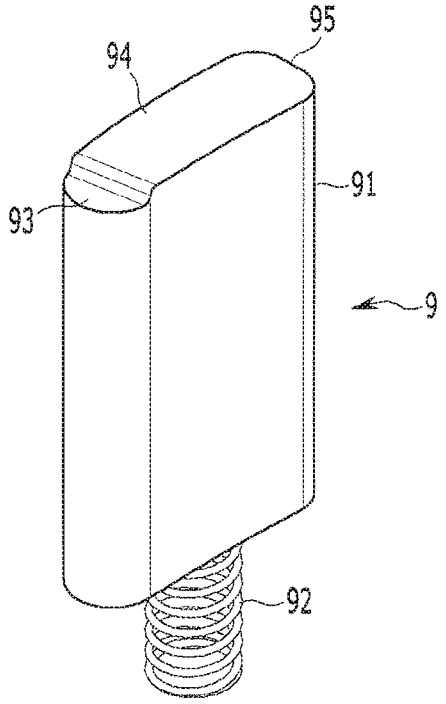
FIG. 9 is an exemplary perspective view of a locking pin according to the exemplary embodiment of the present invention.
Figure 10:
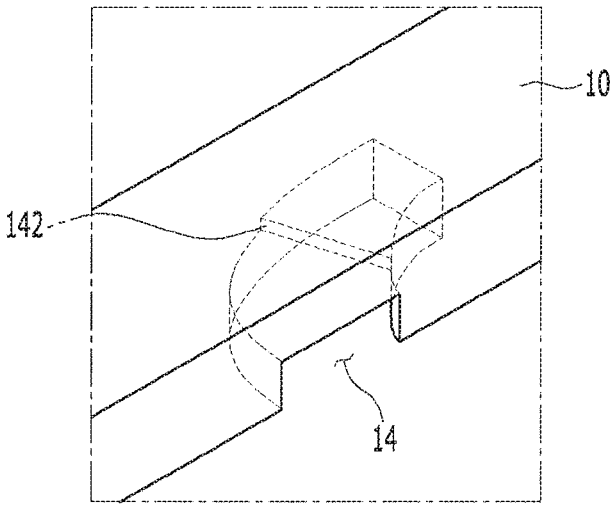
FIG. 10 to FIG. 13 are exemplary detailed views of locking grooves disposed in an upper rail and a lower rail according to the exemplary embodiment of the present invention.
Figure 11:
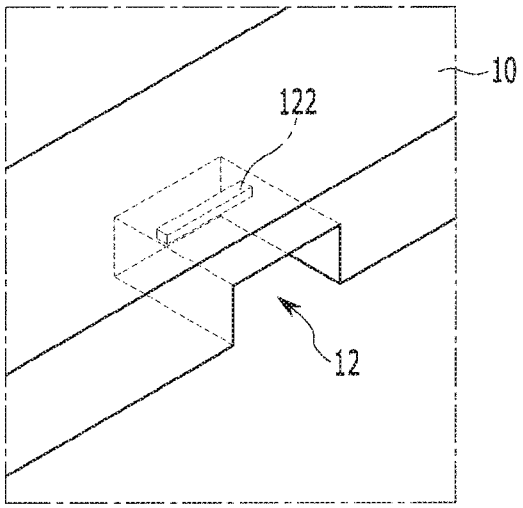
Figure 12:
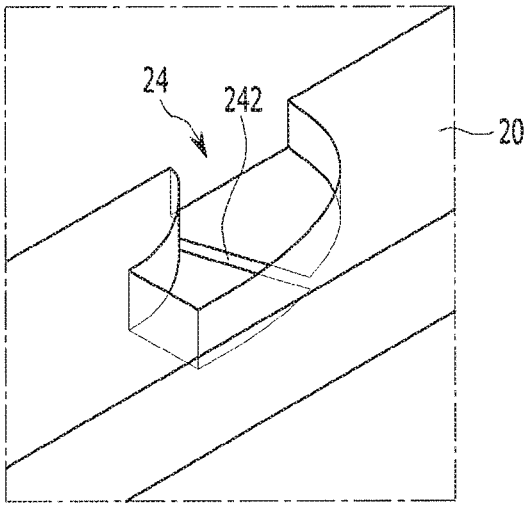
Figure 13:
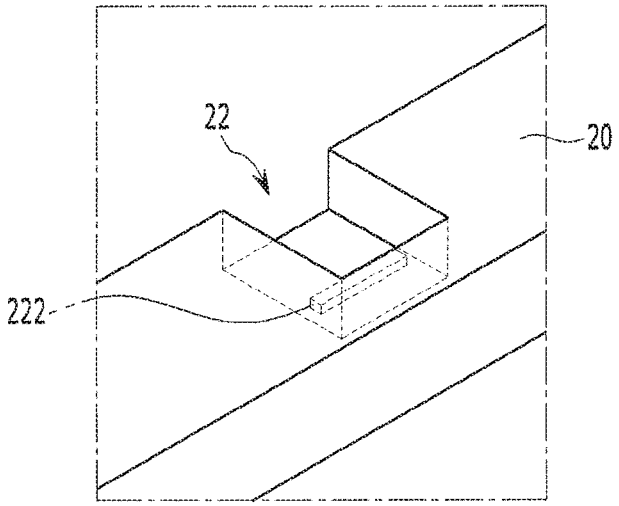

Referring to FIG. 9, the locking pin 9 may include a pin body 91 formed in the shape of a quadrangular block and a return spring 92 disposed to elastically support the pin body 91 from a lower portion of the pin body 91. A partially cut cut-out groove 94 and an inclined portion 94 connected with the cut-out groove 93 may be disposed on the upper surface of the pin body 91 and the cut-out groove 93 and the inclined portion 94 may be configured to enable the locking pin 9 to enter the locking grooves 12, 14, 22, and 24.

Referring to FIG. 10 to FIG. 13, the first locking groove 12 of the upper rail 1 may be formed in a linear arrangement, and the second locking groove 14 of the upper rail 1 may be formed in the shape of a circular arc. A first catching projection 122 may be formed to protrude in the first locking groove 12 and a second catching projection 142 may be formed b to protrude in the second locking groove 14. Additionally, a first locking groove 22 of lower upper rail 2 may be formed in a linear arrangement and a second locking groove 24 of the lower rail 2 may be substantially formed in the shape of a circular arc. First and second catching protrusions 222 and 242 may be formed to protrude into the first and second locking grooves 22 and 24 respectively in the lower rail 2. Accordingly, when the upper and lower locking pins 9 of the front door 3 are completely inserted into the first and second locking grooves 12 and 22 while the front door 3 is being closed, end portions 95 of the locking pins 9 may be locked by the catching protrusions 122 and 222 to fix the position of the front door 3. In other words, the front door 3 may be disposed in a closed position unless an external force greater than predetermined strength is applied thereto.

Figure 14:
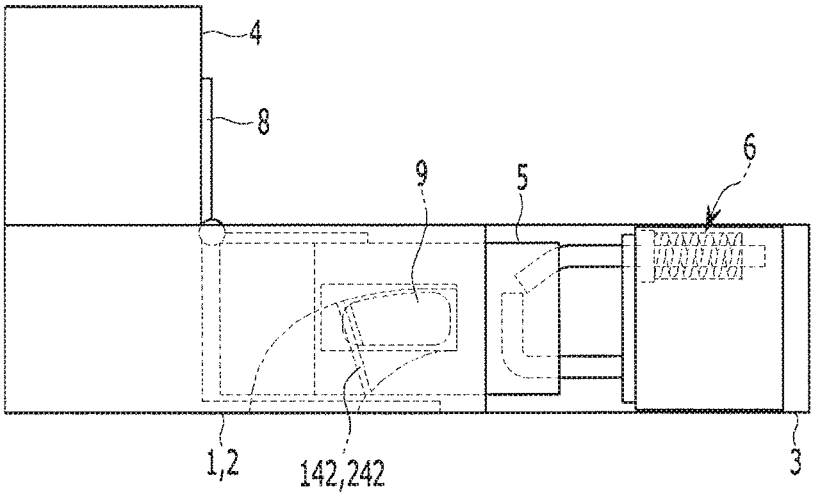
FIG. 14 is an exemplary detail view illustrating a state in which the rear door according to the exemplary embodiment of the present invention is fixed.

In addition, as shown in FIG. 14, when the upper and lower locking pins 9 of the rear door 4 are completely inserted into the first and second locking grooves 14 and 24 when the rear door 4 is being closed, end portions 95 of the locking pins 9 may be temporarily locked by the catching protrusions 142 and 242 to fix the position of the rear door 4. In other words, the rear door 4 may be in a closed position unless an external force greater than predetermined strength is applied thereto. When the front door 3 and the rear door 4 that are temporarily fixed by the locking pins 9 and the catching grooves 12, 14, 22, and 24 receive an external force that exceeds a predetermined strength, the locking pins 9 may be released from the catching grooves 12, 14, 22, and 24 to open the front door 3 and the rear door 4.

Figure 15:
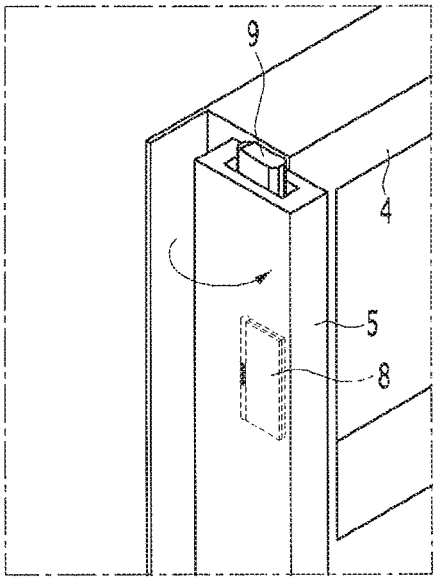
FIG. 15 illustrates an exemplary operation of a center pillar rotatably disposed in the rear door according to the exemplary embodiment of the present invention.
Figure 15:
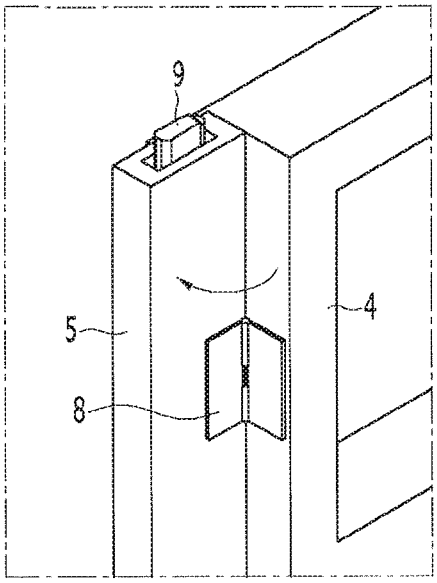

Further, as shown in FIG. 15, when the rear door 4 is being opened, the center pillar may be maintained closely attached to the rear door 4 by the elastic force of the torsion spring 84 of the hinge 8. When the rear door 4 is being closed, the center pillar 5 may be configured to rotate by the locking pins 9 entering along the circular arc-shaped locking grooves 14 and 24 to position the center pillar perpendicular to the rear door 4.

Figure 16:
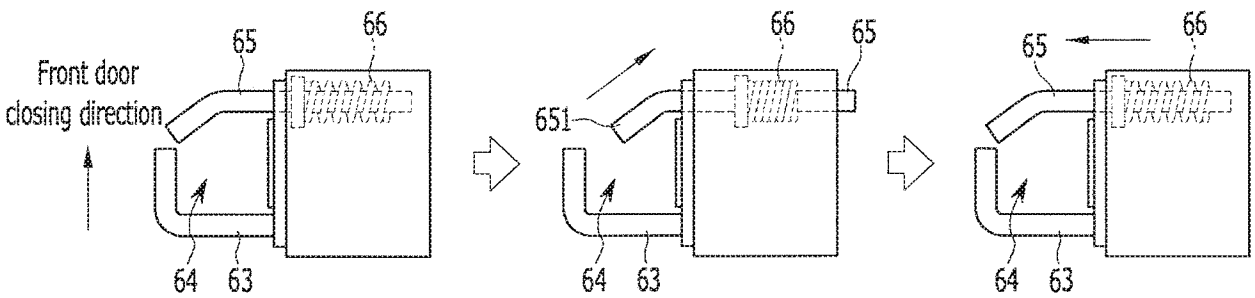
FIG. 16 illustrates an exemplary operation of an active striker according to another exemplary embodiment of the present invention.

Referring to FIG. 16, when the front door 3 is closed after the rear door 4 is closed, the inclined portion 651 of the movable rod 65 of the active striker 6 of the front door 3 may be configured to contact the crew 73 of the latch 7 in the rear door 4. Accordingly, the latch 7 may be pushed rearward and the locking aperture 64 disposed between the locking rod 63 and the movable rod 65 may be opened. When the front door 3 is completely closed and thus fixed by the locking pin 9, the pulled-back movable rod 65 may be configured to return to the original location by a restoration force of the spring 66 to insert the screw 73 of the latch 7 into the locking aperture 64 of the movable rod 65. Accordingly, the front door 3 and the rear door 4 may be maintained in an interlocked state.

While this invention has been described in connection with what is presently considered to be exemplary embodiments, it is to be understood that the invention is not limited to the disclosed exemplary embodiments, but, on the contrary, is intended to cover various modifications and equivalent arrangements included within the spirit and scope of the appended claims.

DESCRIPTION OF SYMBOLS

1: upper rail
2: lower rail
3: front door
4: rear door
5: center pillar
6: active striker
7: latch
8: hinge
9: locking pin

What is claimed is:

1. A door structure of a vehicle, comprising:

a front door and a rear door that are rotatably disposed in the vehicle and configured to be oppositely opened and closed;

a center pillar rotatably disposed in the rear door;

an active striker disposed in the front door; and a latch disposed in the center pillar and configured to be locked or released from the active striker, wherein an upper rail and a lower rail disposed in the door structure respectively include first and second locking grooves that are spaced apart from each other, and wherein locking pins are disposed in the center pillar, and an upper portion and a lower portion of the front door are configured to be fixedly inserted into the first and second locking grooves or released from the first and second locking grooves.

2. The door structure of claim 1, wherein the center pillar is rotatably disposed in the rear door via a hinge.

3. The door structure of claim 2, wherein the hinge includes:

a first mounting flange coupled to the center pillar;

a second mounting flange coupled to the rear door;

a hinge shaft where the first and second mounting flanges are rotatably disposed; and a torsion spring wound around the hinge shaft.

4. The door structure of claim 1, wherein the active striker includes:

a striker body formed as a block and having at least one mounting aperture;

a locking rod formed with a right angle and coupled to the striker;

a movable rod forming a locking aperture coupled with the locking rod or separated from the locking rod and configured to open the locking rod, and includes an inclined portion; and a restoration spring coupled to an exterior surface of the movable rod and configured to elastically support the movable rod.

5. The door structure of claim 4, wherein a first end of an operation cable is coupled to an end of the movable rod and a second end of the operation cable is coupled to an exterior handle disposed on the front door.

6. The door structure of claim 4, wherein the latch includes:

a crew rotatably disposed within a rotation shaft having a locking groove configured to lock or release the active striker; and a return spring that is configured to actuate the crew and return the crew to an original location by elastically supporting the crew.

7. The door structure of claim 6, wherein the crew is coupled to a first end of an operation rod and a second end of the operation cable is connected to an exterior handle disposed in the rear door.

8. The door structure of claim 1, wherein the first locking groove of the upper rail is formed in the shape of a straight line and the second locking groove of the upper rail is formed in the shape of a circular arc, wherein a first catching protrusion protrudes into the first locking groove of the upper rail and a second catching protrusion protrudes into the second locking groove, wherein the first locking groove of the lower rail is formed in the shape of a straight line and the second locking groove of the lower rail is formed in the shape of a circular arc, wherein a first catching protrusion and a second catching protrusions are respectively disposed in the first and second locking grooves of the lower rail, and wherein a locking end is configured to be releasably coupled by the first and second catching protrusions disposed in the locking pin.

9. The door structure of claim 8, wherein the locking pin includes:

a pin body formed in the shape of a quadrangular block; and a return spring configured to elastically support the pin body from a lower portion of the pin body.

10. The door structure of claim 9, wherein the pin body includes a cut-out groove that is partially removed and disposed in an upper surface of the pin body and an inclined portion coupled to the cut-out groove.

* * * * *